United States Patent [19]

Goloff et al.

[11] 4,099,494

[45] Jul. 11, 1978

[54] FUEL SPRAY

[75] Inventors: Alexander Goloff, East Peoria; Frank E. Keske, Chillicothe, both of Ill.

[73] Assignee: Caterpillar Tractor Co., Peoria, Ill.

[21] Appl. No.: 733,974

[22] Filed: Oct. 19, 1976

[51] Int. Cl.[2] ..... F02B 3/00

[52] U.S. Cl. ..... 123/32 JV; 239/533.13

[58] Field of Search ..... 123/32 JV, 139 BF, 137; 261/76, 77; 239/86, 87, 88, 97, 98, 533.13; 251/32; 137/223, 224, 455, 848, 849

[56] References Cited

U.S. PATENT DOCUMENTS

| | | | |
|---|---|---|---|
| 577,362 | 2/1897 | Ettlinger | 239/533.13 |
| 2,303,992 | 12/1942 | Frazer et al. | 239/602 |
| 2,373,555 | 4/1945 | Folke | 239/533.13 |
| 3,186,644 | 6/1965 | Ross et al. | 239/533.13 |
| 3,199,787 | 8/1965 | Oishei et al. | 239/533.13 |

*Primary Examiner*—Charles J. Myhre
*Assistant Examiner*—R. A. Nelli
*Attorney, Agent, or Firm*—Wegner, Stellman, McCord, Wiles & Wood

[57] ABSTRACT

An improved spray nozzle for use in, for example, fuel injection systems in internal combustion engines. The nozzle includes an element having a hollow interior in fluid communication with a liquid pressurizing device. At least one slit is located in the element and the sides of the slits are in abutment with each other for liquid pressures within the interior less than a predetermined value. Pressurizatin of the interior results in the sides of the slit being spaced from each other to permit the liquid to flow from the interior to generate a liquid spray pattern.

13 Claims, 10 Drawing Figures

FUEL SPRAY

BACKGROUND OF THE INVENTION

This invention relates to liquid spray nozzles and, more particularly, to liquid spray nozzles particularly suitable for use in internal combustion engines.

Increasing environmental concerns have resulted in numerous attempts to design spray nozzles for use in fuel injection systems in internal combustion engines that have a so-called "zero sac" volume or wherein the sac volume is minimized. In many prior art constructions, a small volume exists between the fuel flow control, usually a valve, and the outlet of the injection nozzle. After fuel has been injected through the nozzle, liquid fuel will remain within the small volume and will not participate in the combustion process. At later stages of the combustion cycle, the proximity of such liquid fuel to the hot gases of combustion will cause the fuel to vaporize, but since it is not oxidized, it is exhausted from the engine as a hydrocarbon emission.

To minimize the problem, it has been proposed to utilize extremely fine slots in fuel injection nozzles, the sides of which are permanently spaced from each other by a small amount, normally not more than about 0.001 inches or less. As a consequence, there is a sac volume, so the problem is only minimized, not eliminated.

Of further significance is the fact that such narrow slots are extremely difficult to form and the formation of the same to some desired standard of reproducibility requires expensive and complex forming operations.

SUMMARY OF THE INVENTION

It is the principal object of the invention to provide a new and improved spray device as, for example, a spray nozzle for use in fuel injection systems in internal combustion engines. More specifically, it is an object of the invention to provide such a nozzle wherein the same is easily fabricated and wherein there is no sac volume, i.e., the nozzle is a zero sac nozzle.

An exemplary embodiment accomplishes the foregoing objects in an internal combustion engine having a working chamber, a piston movable within the chamber, a fuel injection nozzle associated with the chamber, and means for providing fuel under pressure to the nozzle. The improved nozzle includes an element having a hollow interior in fluid communication with the fuel providing means and at least one slit. The sides of the slit are in abutment with each other for fuel pressures in the interior less than a predetermined value. For pressures in excess of the predetermined value, the sides of the slit are spaced from each other to permit fuel to flow from the interior.

In one embodiment, the nozzle element is a tube having the slit extending along its length.

In another embodiment of the invention, the element is a cup-shaped element and is formed of at least two separate parts. The slit is defined by the interface between the parts.

In the case of the latter embodiment, the cup-shaped element is received and retained within an end of the tube.

According to one embodiment of the latter category, the end of the tube is swaged about the cup-shaped element. A collar may be disposed about the tube end.

In one embodiment, the nozzle element has a uniform thickness adjacent the slit and along the length thereof, while in another embodiment, the element has a non-uniform thickness adjacent the slit and along the length thereof. By appropriately selecting the thickness at any given point, a spray pattern emanating from the slit can be controlled in terms of its dispersion and penetration characteristics.

According to the invention, the nozzle element may be resiliently deformable under pressure to allow the sides of the slit to be spaced from each other. Alternately, where the element is cup-shaped, the tube receiving the same may be made yieldable to allow the slit to open. Orifice area is controlled by appropriately selecting the physical characteristics of the nozzle element and/or supporting tube.

In a highly preferred embodiment wherein the nozzle element is cup-shaped, it is press-fit within an end of the tube.

The invention also contemplates that the inventive nozzle be employed in spray applications other than fuel injection devices.

Other objects and advantages will become apparent from the following specification taken in connection with the accompanying drawings.

DESCRIPTION OF THE PREFERRED EMBODIMENTS

Figure 1:
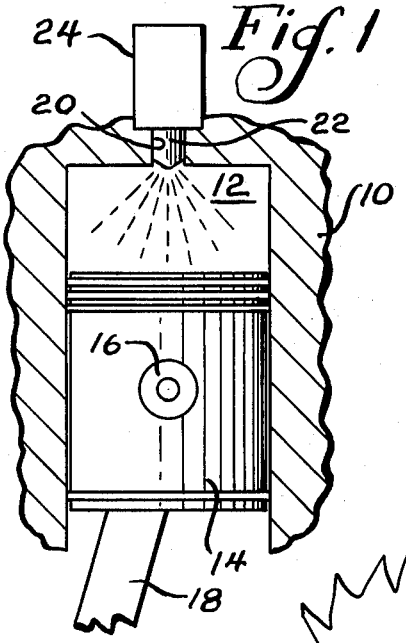
FIG. 1 is a somewhat schematic view of a reciprocating, internal combustion engine embodying a fuel injection system having a nozzle made according to the invention.

An exemplary embodiment of a fuel injection system embodying a nozzle made according to the invention is illustrated in FIG. 1 in connection with an internal combustion engine having a housing 10 defining a working chamber 12. A piston 14 is reciprocal within the working chamber 12 and is mounted, by means of a wrist pin 16, to a connecting rod 18 which in turn is connected to a crank shaft not shown.

The housing 10 includes a bore 20 which receives a fuel injection nozzle 22. Fuel under pressure is delivered to the nozzle 22 by a pump 24 which may be of conventional construction. In general, the pump will supply fuel to the nozzle 22 at high pressures, typically on the order of 5,000 psi or more, and frequently, in excess of 12,000 psi.

It is to be understood that while the internal combustion engine illustrated is a reciprocating engine embodying a reciprocating piston 14, the invention can be employed advantageously in rotary engines having rotary pistons as, for example, trochoidal and slant axis rotary engines.

Figure 2:
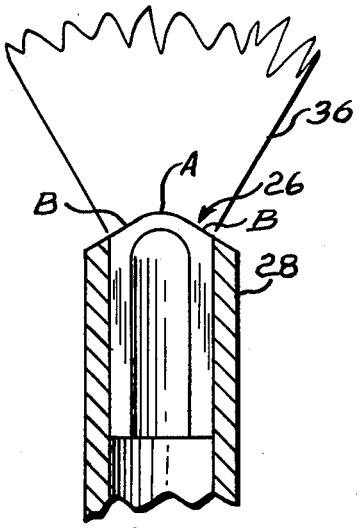
FIG. 2 is a sectional view of one embodiment of a nozzle made according to the invention.
Figure 3:
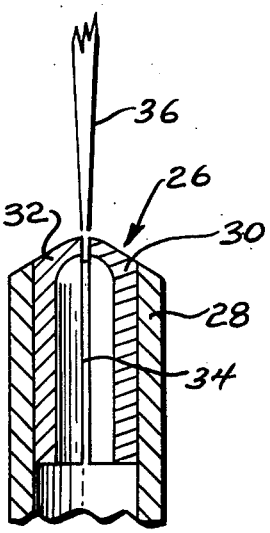
FIG. 3 is a view of the nozzle of FIG. 2 taken at approximately right angles thereto and illustrating the configuration of the components during the ejection of a spray therefrom.

Turning now to FIGS. 2 and 3, one nozzle structure made according to the invention is illustrated in detail and is seen to include an inverted, cup-shaped element, generally designated 26, received in the end of a tube 28. The cup-shaped element 26 is formed of two separate parts 30 and 32 which are symmetrical and will be typically formed of metal or the like, as will be the tube 28. The parts 30 and 32 are abutted against each other within the tube 28 so that the interface 34 between the two parts 30 and 32 defines a slit which extends through the bottom of the cup-shaped element 28. As seen in FIGS. 2 and 3, the bottom extends slightly outwardly from the end of the tube 28.

Fuel under pressure is directed by the pump 24 to the interior of the cup-shaped element 26 via the tube 28 and fuel emanating from the slit 34 will generate a fan-shaped spray pattern 36.

When fuel delivered to the interior of the cup-shaped element 26 is less than some predetermined pressure, the slit 34 will be closed with the sides of the parts 30 and 32 in tight abutment with each other. The components are dimensioned so that the tube 28 will hold the parts 30 and 32 is such a configuration.

When fuel at a pressure in excess of the predetermined pressure is delivered to the interior of the structure, such pressure will cause either or both of the cup-shaped element 26 and the tube 28 to resiliently deform radially outwardly to allow the slit 34 to open so that the spray 36 will be generated.

The opening pressure as well as the size of the orifice area of the slit 34 when open for a given fuel pressure may be controlled in any of a variety of ways. For example, where deflection of the parts 30 and 32 under pressure causes the slit 34 to open, control may be effected by suitably selecting the material of which the parts 30 and 32 are formed as well as controlling the thickness of the bottom of the cup-shaped element 26. Alternately, the parts 30 and 32 may be constructed of a material that will not noticeably deflect for the pressures of concern and opening characteristics controlled by the hoop strength of the tube 28. Moreover, if desired, the parts 30 and 32 may be press-fit within the tube 28 so as to be in compression when no pressure is applied, the amount of such compression being utilized as a control parameter to control the pressure at which the slit 34 will open and the size of the orifice area.

It is to be noted that in the embodiment shown in FIGS. 2 and 3, the parts 30 and 32, adjacent the slit 34, at the bottom of the cup-shaped element 28 which serves as the ejection orifice, are of non-uniform thickness. For example, at the point marked A, the thickness of the components is less than at the point marked B. By suitably selecting the thickness, a variety of spray characteristics can be achieved. Where the thickness is relatively great, the emanating spray will have minimum dispersion and maximum penetration into the depths is the working chamber 12. Conversely, where the thickness is relatively small, there will be maximum dispersion and minimum penetration.

In the embodiment illustrated in FIGS. 2 and 3, no special means are provided for restraining the parts 30 and 32 within the end of the tube 28 when subjected to great pressure insofar as separate retaining elements or fabricating operations are concerned. However, it will be observed that the substantial length of the cup-shaped element 28 relative to its diameter will effect retention of the parts 30 and 32. In particular, the area of the interior of the cup-shaped element 26 as well as its lowermost end considered transversely to the axis of the tube 28 will be low as compared to the surface area of the interior of the element 26 radially of the tube axis 28. As a result, the application of pressure to the interior of the element 26 will result in the application of a significantly greater force extending radially outwardly of the tube axis than that operating along the tube axis. The greater force will cause the sides of the cup-shaped element 26 to tightly frictionally grip the interior of the tube 28 to provide for retention.

Figure 5:
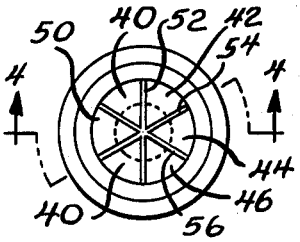
FIG. 5 is a plan view of the nozzle shown in FIG. 4 illustrating the configuration of components while a spray is being ejected therefrom.
Figure 4:
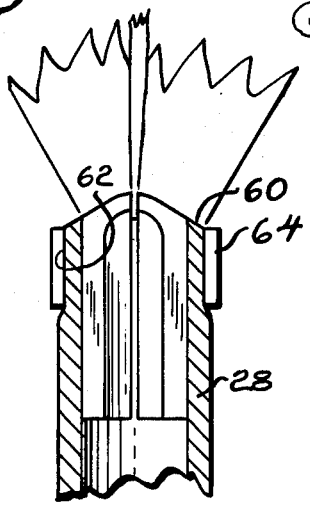
FIG. 4 is a view similar to FIG. 2 but of a modified embodiment of a nozzle and is taken approximately along the line 4—4 of FIG. 5.

FIGS. 4 and 5 illustrate a modified embodiment of the nozzle construction wherein three fan-shaped spray patterns are generated as opposed to but the single spray pattern 36 generated by the embodiment shown in FIGS. 2 and 3. In particular, rather than employing two parts 30 and 32 to form the cup-shaped element 26, six parts 40, 42, 44, 46, 48 and 50 are employed and in the embodiment illustrated, the same are symmetrical so as to provide three equally angularly spaced slits 52, 54, 56. However, if an asymmetrical spray pattern is desired, only certain of the parts 42–50 will be symmetrical and the angular spacing between the slits 52, 54 and 56 would vary depending upon the particular pattern desired.

In addition, the embodiment illustrated in FIGS. 4 and 5 differs from that shown in FIGS. 2 and 3 in that the end 60 of the tube is swaged radially inwardly as at 62 to hold the parts 42–50 in place and provide a certain compressive force thereto.

Optionally, but desirably, a ring-like collar 64 is fitted on the swaged end 60 of the type 28 to resist yielding of the components. Accordingly, orifice area, etc., can be controlled through the configuration of the collar 64 as well as the material of which it is made.

Figure 6:
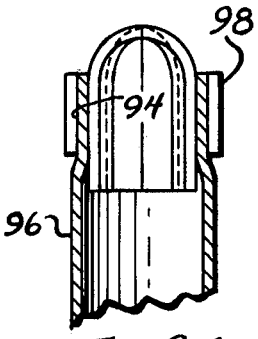
FIG. 6 is a view similar to FIG. 2, but of a modified embodiment of a nozzle made according to the invention and wherein no spray is being ejected, and taken approximately along the line 6—6 of FIG. 7.
Figure 7:
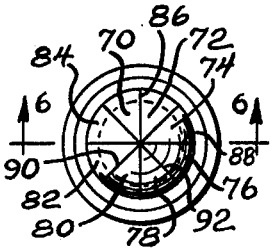
FIG. 7 is a plan view of the nozzle illustrated in FIG. 6.

FIGS. 6 and 7 illustrate a further modified embodiment of the invention wherein the cup-shaped element is formed of eight symmetrical segments 70, 72, 74, 76, 78, 80, 82, 84, thereby defining four equally angularly spaced slits 86, 88, 90, 92. As seen in FIG. 7, the slits 86–92 are in a closed configuration as opposed to the open configuration of the slits shown in the embodiments of FIGS. 2–5, inclusive.

Again, if an asymmetrical spray pattern is desired, the equal angular spacing of the segements may be dispensed with by making certain or all of the segments asymmetrical.

Whereas in the embodiments illustrated in FIGS. 2–5 the thickness of the cup-shaped member defined by the various parts varies in the vicinity of the bottom of the cup-shaped member adjacent the slits, as seen in FIG. 6, the parts 72–84 have a uniform thickness. To the extent that the application of fuel under pressure to the interior of the cup-shaped element shown in FIGS. 6 and 7 will cause the slits 86, 88, 90 and 92 to open uniformly from one side to the other, the resulting spray would have uniform dispersion and penetration characteristics from one side to the other. In practice, however, the width of the slits adjacent the ends thereof will be less than at points intermediate their ends due to restraints on the cup-shaped elements imposed by means to be described hereinafter.

As a consequence, due to the lesser width of the orifice adjacent the ends of the slits, the spray will have less penetration and more dispersion in such areas than at intermediate areas. If it is desired to have uniform dispersion and penetration characteristics from end to end of the slits, it would be necessary to thicken the segments 70, 72, 74, 76, 78, 80, 82 and 84 adjacent the ends along the lines of the embodiments shown in FIGS. 2–5.

It will be observed that the embodiment illustrated in FIG. 6 also employs a swaged end 94 of a tube 96 receiving the parts 70–84 as well as a ring-like collar 98 similar to the collar 64.

Figure 8:
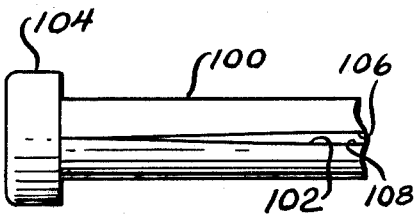
FIG. 8 is a fragmentary elevational view of still another modified embodiment of the invention showing the configuration of the components during the ejection of a spray from the nozzle.
Figure 9:
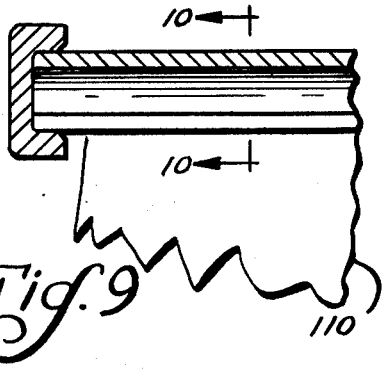
FIG. 9 is a sectional view of the nozzle illustrated in FIG. 8.
Figure 10:
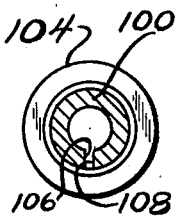
FIG. 10 is a sectional view taken approximately along the line 10—10 of FIG. 9.

FIGS. 8–10 show still a further modified embodiment of the invention which may be utilized advantageously in, for example, a rotary engine, such as a so-called "Wankel" engine wherein it is desired to substantially uniformly distribute a spray pattern across the width of a rotary piston within the working chamber. In particular, an elongated tube 100 is utilized and the same includes a slit 102 extending along its length. One end of the tube 100 is capped at 104, while the other end will be in fluid communication with the pump 24.

As illustrated, the interior of the tube 100 is subjected to fuel under pressure so that the sides 106 and 108 of the slit 102 are spaced to allow a fuel spray 110 to emanate from the slit 102. When unpressurized, the sides 106 and 108 will be in abutment with each other and, as can be seen from FIG. 8, where the tube 100 is restrained from yielding under pressure at its end by the cap 104, the slit 102 progressively narrows as the cap 104 is approached.

It will be appreciated that the tube 100 and the slit 102 therein need not be linear but could be curved or bent to any desired configuration to provide a desired spray pattern. It will also be appreciated that the slit 102 need not extend along the entire length of the tube 100, but only partially along its length, if desired.

As with the case of the embodiment illustrated in FIGS. 6 and 7, the uniform thickness of the tube will not produce a spray having uniform dispersion and penetration characteristics since the slit 102 will not open to as great a width adjacent its ends as illustrated in FIG. 8. Where such a spray pattern is desired, nothing more need be done. Where, however, a uniform spray is desired from one end of the slit to the other, modifications to tube thickness in appropriate areas can be made in the manner mentioned previously.

Fron the foregoing, it will be appreciated that nozzles made according to the invention achieve the objects of inexpensive construction in that no special techniques are required for the formation of the slit since the nozzle elements, in the case of the embodiments illustrated in FIGS. 2–7, are separately formed and the slits are defined by the interface of such elements. Similarly, in the case of the embodiment illustrated in FIGS. 8–10, the slit 102 can be formed by a relatively economical cutting operation and then the tube 100 circumferentially collapsed to cause the sides 106 and 108 to abut each other.

It will also be appreciated that nozzles made according to the invention have zero sac volume in that when the slits are not open, following the injection process, there is no volume exposed to the working chamber 12 which would contain a quantity of fuel that would not participate in the combustion process but which would be vaporized and result in hydrocarbon emissions.

It will also be appreciated that the invention provides great design flexibility in terms of allowing the variants of dispersion and penetration characteristics as well as the provision of spray patterns of a variety of configurations.

What is claimed is:

1. In an internal combustion engine having a working chamber, a piston movable within said chamber, a fuel injection nozzle within the chamber, and a means for providing fuel under pressure to said nozzle, the improvement wherein said nozzle includes an element having a hollow interior in fluid communication with said fuel providing means, and at least one slit in said element, the sides of said slit being in abutment with each other for fuel pressures in said interior less than a predetermined value, said sides being spaced from each other to permit fuel to flow from said interior in response to fuel pressures within said interior greater than said predetermined value.

2. The internal combustion engine of claim 1 wherein said element is an elongated tube and said slit extends along said tube.

3. The internal combustion engine of claim 1 wherein said element is cup-shaped and formed of at least two separate parts, said slit being defined by the interface between said parts.

4. The internal combustion engine of claim 3 wherein said cup-shaped element is received and retained within the end of a tube.

5. The internal combustion engine of claim 4 wherein the end of the tube is swaged about said cup-shaped element.

6. The internal combustion engine of claim 4 including a collar disposed about said tube end.

7. The internal combustion engine of claim 1 wherein said element has a uniform thickness adjacent said slit and along the length thereof.

8. The internal combustion engine of claim 1 wherein said element has a non-uniform thickness adjacent said slit and along the length thereof.

9. The internal combustion engine of claim 1 wherein said element is resiliently deformable to allow said sides to be spaced from each other.

10. The internal combustion engine of claim 1 wherein said element is cup-shaped and formed of at least two parts, said slit being defined by the interface of said parts, and a resilient tube receiving and retaining said parts.

11. The internal combustion engine of claim 10 wherein said parts are press-fit within an end of said tube.

12. A liquid spray device comprising a cup-shaped element defined by at least two separate, substantially symmetrical, metal parts in abutment with each other along their lengths, the interface between said parts defining a slit, and means assembling said parts together such that said slit will normally be closed, at least one of said parts and said assembling means being resiliently deformable to allow said slit to open such that when a liquid under high pressure is directed to the interior of said cup-shaped element, a spray will emanate from said slit.

13. The spray device of claim 12 wherein said assembling means comprises a tube having an end, said cup-shaped element being disposed in said end with the bottom of said cup-shaped element extending outward from said end, said end being swaged about said cup-shaped element.

* * * * *